United States Patent [19]

Ginsburg

[11] 3,949,432

[45] Apr. 13, 1976

[54] CUSHIONED TOILET SEAT

[75] Inventor: Milton Ginsburg, Bala Cynwyd, Pa.

[73] Assignee: Ginsey Industries, Inc., Lester, Pa.

[22] Filed: May 30, 1974

[21] Appl. No.: 474,520

[52] U.S. Cl. ..... 4/237

[51] Int. Cl.[2] ..... A47K 13/00; A47K 13/02

[58] Field of Search ..... 4/234, 236, 237, 240, 242; 297/459; 5/338, 347; 428/65, 315, 321

[56] References Cited

UNITED STATES PATENTS

| | | | |
|---|---|---|---|
| 2,899,689 | 8/1959 | Pastl | 4/237 |
| 3,533,896 | 10/1970 | Hartig | 161/161 X |
| 3,639,922 | 2/1972 | Samuels et al. | 4/237 |
| 3,753,846 | 8/1973 | Trouilhet | 161/160 X |

*Primary Examiner*—Richard E. Aegerter
*Assistant Examiner*—Stuart S. Levy
*Attorney, Agent, or Firm*—Paul & Paul

[57] ABSTRACT

A cushioned toilet seat has a lightweight yet strong, relatively thin, annular base member of molded plastic having inner and outer narrow annular vertical flanges and narrow vertical reinforcing ribs forming wide channels therebetween. Supported on the annular base is a foamed plastic cushion, preferably polyurethane, which is plano-convex in cross section. The base and cushion are encased in a tight wrinkle-free plastic film, preferably vinyl, which consists of two pieces of film fused together. Vents are provided through the base to provide communication between the foamed cushion and the atmosphere to allow air to escape from the cushion as it is compressed and to allow air to return to the cushion to accelerate the return of the cushion to its fully expanded condition.

2 Claims, 4 Drawing Figures

CUSHIONED TOILET SEAT

BACKGROUND OF THE INVENTION

This invention relates to toilet seats, and particularly to cushioned toilet seats. Cushioned toilet seats have been made heretofore but such prior cushioned seats, if adequately strong, have been unduly heavy.

An object of the present invention is to provide an improved cushioned toilet seat which is light in weight, yet has adequate strength for its intended purpose, and is economical to manufacture.

The foregoing object is obtained by providing a cushioned toilet seat having a light weight molded base of plastic having inner and outer annular flanges and intermediate narrow ribs forming therebetween wide channels through which air may flow into vertical vents which extend through the base and vinyl covering to allow for the escape of air when the cushion is compressed and to allow for the return of air to accelerate expansion of the cushion to its uncompressed fully expanded condition.

The cushioned toilet seat of the present invention is an improvement over the seat shown in Pastl U.S. Pat. No. 2,899,689, issued Aug. 18, 1959. In the Pastl seat, the flat upper surface of the base is provided with a grid of narrow grooves and the base portions between the grooves are wide relative to the grooves.

DETAILED DESCRIPTION OF THE PREFERRED EMBODIMENTS

Figure 1:
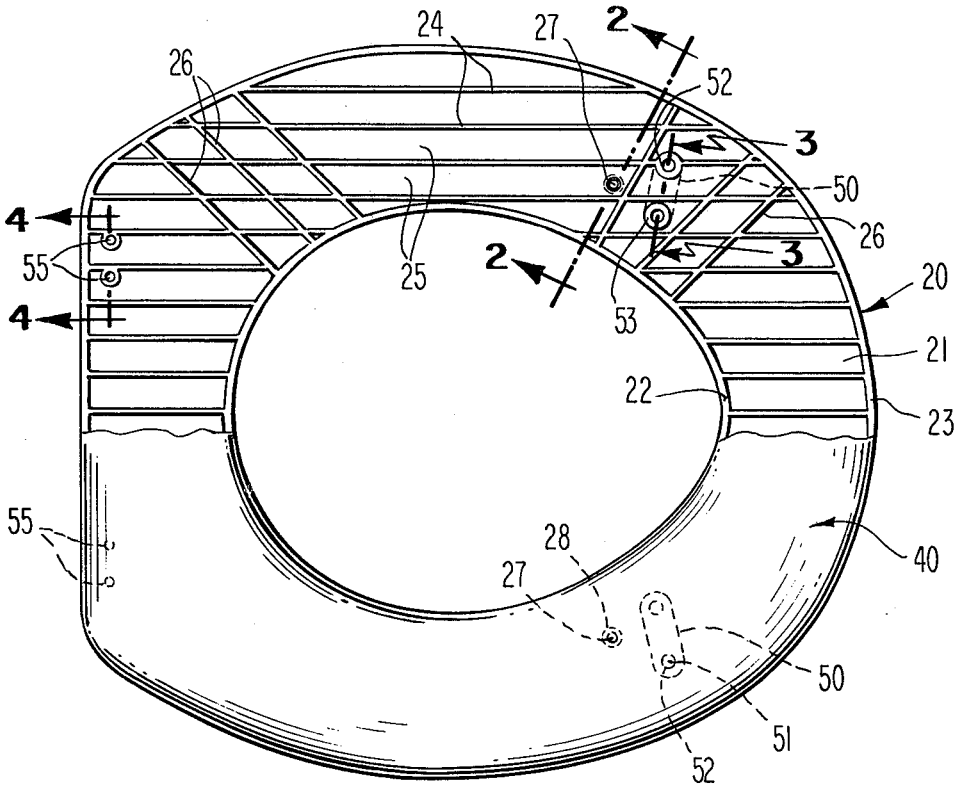
FIG. 1 is a plan view, partly broken away, of a cushioned toilet seat according to the present invention.

Referring now to the drawings, the cushioned toilet seat consists of an annular base member 20, an annular cushion member 30 which is supported on the base member 20, and a tight fitting wrinkle-free cover 40 of plastic film of attractive color and design.

The annular base member 20 has a flat undersurface 21 but its upper surface is characterized by an inner annular flange 22, an outer annular flange 23 and narrow lengthwise-extending reinforcement ribs 24 forming wide, lengthwise channels 25. Cross ribs 26 are provided at selected locations. The base 20 is preferably of plastic and is preferably formed by injection molding.

Figure 2:
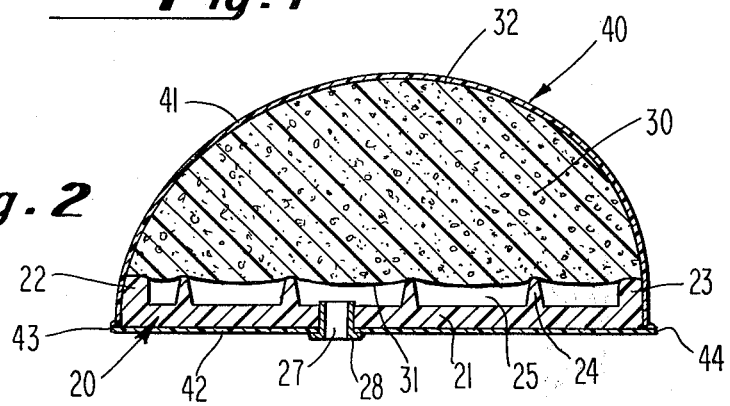
FIG. 2 is a view, in vertical section, taken along the line 2—2 of FIG. 1.

The annular cushion 30, which is supported on the annular base 20, may preferably be custom molded, fire-retardant, high-resilient polyurethane. The cushion 30 has a flat bottom surface 31 and a convex upper surface 32. As seen in FIG. 2, the cushion 30 is supported on the ribs 24, cross ribs 26 and on the inner and outer flanges 22, 23. Vertical vent holes 27 are provided through the base and through the plastic film cover 40 to provide communication between the wide channels 25 and the exterior atmosphere. Metal or plastic eyelets 28 of attractive appearance may preferably be inserted through the film cover into the vent holes 27. The eyelets 28 have an annular flange portion adapted to abut against the plastic film covering at the under-surface of the base.

An important function of bumpers, which are ordinarily attached to the undersurface of toilet seats, is to provide a cushioning effect when the seat is dropped, to avoid breakage of the seat and to avoid noise. The cushioned toilet seat of the present application is sufficiently light in weight and sufficiently strong so that bumpers are not essential. Nevertheless, the molded plastic base 20 of the present invention may include provision for bumpers, and such bumpers 50 are shown in the drawing. Bumpers 50 include a pair of posts 51 which are inserted into post holes 52 provided in the molded plastic base. The post holes 52 are preferably defined by bosses 53 to increase the length of the sidewalls of the post holes, thereby to provide more sidewall support for the bumper posts 51.

As previously indicated, the bumpers may be omitted, in which case the post holes 52 may be used as additional vent holes.

Figure 4:
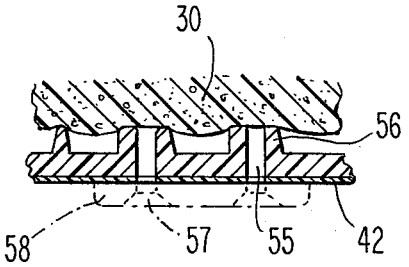
FIG. 4 is a view, in section, taken along the line 4—4 of FIG. 1.
Figure 3:
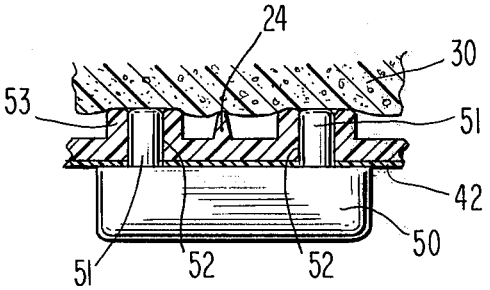
FIG. 3 is a view, in section, taken along the line 3—3 of FIG. 1.

The molded plastic base 20 includes, at the rear end thereof, two pairs of holes 55 for two hinges. One pair of such holes is visible in FIG. 1. The hinge holes 55 may be defined by bosses 56 to increase the length of the sidewalls of the holes, thereby to provide an increased amount of material for receiving and supporting the screws 57 of the hinges 58, shown in phantom in FIG. 4.

As previously indicated, the structure described is completely encased in a tightly-wrapped wrinkle-free plastic film 40, preferably vinyl, for example, 18-gauge vinyl. The vinyl covering 40 is formed in two pieces, a convex upper piece 41 and a flat bottom piece 42. The upper piece 41 is formed by a vacuum forming in an annular mold and, in the manufacturing process, is formed in upside down position. The bottom piece of film 42, in the manufacturing process, is made from a square or rectangular piece of film which is placed on the top of the mold, after the other piece of film 41 has been vacuumed formed in the annular cavity thereof and after the foam cushion 30 and molded plastic base 20 have been placed therein. The two vinyl pieces 41 and 42 are then fused together at the inside and outside edges of the annular mold by an electronic heat sealer. These fused seals are identified in FIG. 2 of the drawing as 43 and 44. After the seals are made, the excess material, both inside and outside of the annular area, is torn off. No cutting is necessary.

The vents 27 have several purposes. A first purpose is to reduce the strain on the seals. By allowing the air, which is contained in the cells of the foam cushion 30, to escape through the vents 27 when the foam cushion is compressed, the strain on the seals 43 and 44 is considerably decreased. A second purpose is to reduce the time required for the foam cushion 30 to recover to its normal fully expanded condition after it has been depressed. The vents 27, by allowing exterior air to pass inwardly into the cells of the foam, reduce the time required for the cushion to return to its fully expanded condition. This second function of the vents 27 has an aesthetic purpose. It avoids a temporary wrinkled appearance after the seat has been used.

The molded plastic base 20 of the present application is to be clearly distinguished from the base shown in the Pastl patent, U.S. Pat. No. 2,899,689. In Pastl, the top side of the base piece is flat but has therein a plurality of interconnected narrow grooves which extend lengthwise and crosswise, In contrast to Pastl, the upper surface of the molded base 20 of the present application may be said to be provided with a plurality of ribs, rather than grooves as in Pastl.

In the present application, the wide channels 25 formed between the narrow ribs 24 perform two functions. One, these channels receive portions of the foam cushion material 30 when downward pressure is applied to the upper surface of the seat. Secondly, the channels facilitate rapid passage of air from the cells of the foam cushion 30 through the vent holes 27 to atmosphere, and the rapid return thereof when the pressure is removed.

What is claimed is:

1. a cushioned toilet seat comprising:

a. an annular base of molded plastic material having a flat under surface and an upper surface having upstanding inner and outer peripheral flanges and upstanding narrow ribs at spaced apart locations extending between said inner and outer flanges forming, on each side of the center line, at least one wide deep channel therebetween, the width of said channels being at least several times greater than said ribs;

b. an annular foam plastic cushion supported on said ribs and peripheral flanges, said cushion having a normally substantially flat bottom and a convex top surface, said bottom when said cushion is depressed tending to push down into said channels but without filling said channels leaving substantial space therein for air passage therethrough;

c. a plastic film tightly encasing said base and cushion, said film having fused seals near the inner and outer edges of said annular base;

d. vent holes extending through said base and film encasement into said channels at locations in the forward half only of said seat near to but spaced from the bumper locations for providing air communication between said channels and atmosphere.

2. A cushioned toilet seat according to claim 1 wherein:

(a) eyelets are inserted into said vent holes, said eyelets having an annular flange which abuts against said film encasement surrounding said vent hole at the undersurface of said base.

* * * * *